US010777350B2

(12) United States Patent
Holzer et al.

(10) Patent No.: US 10,777,350 B2
(45) Date of Patent: Sep. 15, 2020

(54) ARRANGEMENT FOR REDUCING RADIATION OF NOISE FROM LIQUID-COOLED TRANSFORMERS OR CHOKES

(71) Applicant: Siemens Aktiengesellschaft, Munich (DE)

(72) Inventors: Anton Holzer, Weiz (AT); Helmut Pregartner, Krottendorf (AT); Guenter Pretterhofer, Gleisdorf (AT); Alfons-Karl Schrammel, Waldbach (AT)

(73) Assignee: Siemens Aktiengesellschaft, Munich (DE)

( * ) Notice: Subject to any disclaimer, the term of this patent is extended or adjusted under 35 U.S.C. 154(b) by 317 days.

(21) Appl. No.: 15/552,360

(22) PCT Filed: Jan. 20, 2016

(86) PCT No.: PCT/EP2016/051083

§ 371 (c)(1),
(2) Date: Aug. 21, 2017

(87) PCT Pub. No.: WO2016/134888

PCT Pub. Date: Sep. 1, 2016

(65) Prior Publication Data

US 2018/0047500 A1 Feb. 15, 2018

(30) Foreign Application Priority Data

Feb. 27, 2015 (EP) ..... 15156920

(51) Int. Cl.
*H01F 27/33* (2006.01)
*G10K 11/16* (2006.01)
*G10K 11/168* (2006.01)

(52) U.S. Cl.
CPC ..... *H01F 27/33* (2013.01); *G10K 11/161* (2013.01); *G10K 11/168* (2013.01)

(58) Field of Classification Search
CPC ..... H01F 27/33; G10K 11/168; G10K 11/161
(Continued)

(56) References Cited

U.S. PATENT DOCUMENTS 4,215,763 A 8/1980 Pasko
8,028,800 B2 * 10/2011 Ravnaas ..... E04B 1/86 181/284

(Continued)

FOREIGN PATENT DOCUMENTS

CN 101126224 2/2008
CN 104335301 2/2015

(Continued)

*Primary Examiner* — Forrest M Phillips
(74) *Attorney, Agent, or Firm* — Cozen O'Connor

(57) ABSTRACT

An arrangement for reducing the radiation of noise from liquid-cooled transformers or chokes includes a tank having stiffeners arranged outside on the side walls of the tank, where a region situated between each stiffener is covered by a sandwich panel that is fastened to each stiffener, where each sandwich panel has a metallic wall that hermetically closes off a cavity that is filled with a composition composed of a polymer material and a filler material, where the composition has a specific weight of >2 grams per cubic centimeter.

14 Claims, 2 Drawing Sheets

(58) Field of Classification Search
USPC ..... 181/198, 200, 202
See application file for complete search history.

(56) References Cited

U.S. PATENT DOCUMENTS

| | | | | |
|---|---|---|---|---|
| 2008/0099275 | A1* | 5/2008 | Seel | F04B 39/0033 181/202 |
| 2011/0147115 | A1* | 6/2011 | Ertl | G10K 11/16 181/202 |
| 2015/0352950 | A1* | 12/2015 | DeTuncq | B60K 25/00 181/198 |
| 2016/0104568 | A1* | 4/2016 | Best | H01F 5/02 336/199 |
| 2017/0110239 | A1* | 4/2017 | Ruiz Escobedo | H01F 27/33 |

FOREIGN PATENT DOCUMENTS

| | | | | |
|---|---|---|---|---|
| CN | 2018-93422 | A | * | 4/2018 |
| CN | 2018-89013 | T | * | 5/2018 |
| DE | 2309564 | | | 9/1974 |
| DE | 102012012442 | | | 12/2013 |
| WO | WO2013182227 | | | 12/2013 |

* cited by examiner

ARRANGEMENT FOR REDUCING RADIATION OF NOISE FROM LIQUID-COOLED TRANSFORMERS OR CHOKES

CROSS-REFERENCE TO RELATED APPLICATIONS

This is a U.S. national stage of application No. PCT/EP2016/051083 filed 20 Jan. 2016. Priority is claimed on European application no. EP15156920 filed Feb. 27, 2015, the content of which is incorporated herein by reference in its entirety.

BACKGROUND OF THE INVENTION

1. Field of the Invention

The invention generally relates to the technical field of electrical transformers or chokes and, more particularly, to an arrangement for reducing the emission of operating noises from a liquid-cooled transformer or from a choke.

2. Detailed Description of the Related Art

During operation of a liquid-cooled transformer or a choke, the vibration excited in the magnetic core and/or electrical winding propagates via the insulating and cooling fluid to the walls of the tank, with the result that flexural vibrations are excited in these walls, and operating noises are emitted to the outside.

Various actively and passively acting systems are known for reducing the sound emission. In passively acting systems, insulating measures are usually provided on the outside of the tank. For example, DE 1 293 329 provides heavy external plates, with the cavity between external plate and tank wall being filled with foamed plastics material. DE 1 902 910 and DE 2 309 564 also propose filling the cavity formed between a cover plate and reinforcement with an easily deformable polyurethane foam.

Despite various approaches to solving the problem of noise emission from transformers and chokes, a satisfactory solution has yet to be found. The requirements for minimum possible operating noises continue to rise, in particular when a transformer or choke is meant to be installed in the vicinity of a residential area. One particular problem is the requirement for a long operational life. As a result of aging effects, the sound-insulating action of a polymer material exposed to the environmental conditions prevailing at the operating site decreases as the period of operation increases.

SUMMARY OF THE INVENTION

In view of the foregoing, it is an object of the present invention to provide an arrangement that can be used to reduce, over as long an operational life as possible, the sound emission from a transformer or choke at minimum possible cost.

This and other objects and advantages are achieved in accordance with the invention by an arrangement having sandwich panels that act as insulating elements arranged externally on the tank of a liquid-cooled transformer or choke. Each sandwich panel comprises a hermetically sealed cavity. The cavity contains a composition of a polymer material and a filler, said composition having a specific weight of >2 grams per cubic centimeter. The cavity is completely enclosed by a metallic casing. This hermetic encapsulation ensures that the polymer material is completely screened against external influences. Hence, the aging behavior of the polymer remains substantially unchanged over a long operational life and experiences almost no alteration in its physical nature. Using epoxy resin as the polymer material creates a metal-plastics combination which, unlike conventional arrangements, is not flexible but forms a relatively rigid sandwich construction, the mass of which is increased by a filler. In other words, although the sandwich panel in accordance with the invention is comparatively heavier than a metal-plastics-metal construction, it is not so heavy that it would cause a problem to attach the sandwich panel to the external wall of the tank. The invention achieves an advantageous compromise between mass and sound-insulating action.

A particularly suitable material as a filler is a material having a high specific weight, such as a metal. It proves particularly good value to use what is known as a steel abrasive, i.e., steel particles of diameter in the range of 1 to 2 mm, for example. Steel abrasive is a low-cost filler, is commercially available, and is used industrially for surface finishing, for example.

A mineral material such as silica sand, for example, can also be a low-cost filler, however.

It appears to be mechanically advantageous to structure the sandwich panel as a cuboid. A cuboid having a rectangular cross-section can be fitted particularly easily to the external peripheral surface of the tank, either between protruding tank stiffeners or on the end faces of the stiffeners.

In an advantageous embodiment of the invention, each sandwich panel is arranged externally between two protruding stiffeners, completely covering the region of the tank wall that lies between the stiffeners. The connection between the sandwich panel and stiffener can be made cheaply by a welded joint.

In another particularly preferred embodiment of the invention, each sandwich panel is attached via a detachable connection on an end face of a stiffener, with the interposition of an elastic element. As a result, it is possible to fit the sandwich panels once they are at the installation site of the transformer or choke. One advantage of this is that the smaller external dimensions make it easier to transport this large industrial equipment. Another advantage is that a transformer or choke that is already in operation can be retrofitted with sound-insulating sandwich panels.

It has proved advantageous for the insulating action if an elastic element, such as a rubber strip (neoprene or cellular rubber), is arranged between sandwich panel and tank wall and/or stiffener of the tank wall. The emission of operating noises can be reduced particularly efficiently by this mechanical decoupling between insulating panel and tank.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In order to explain the invention in greater detail, reference is made in the following part of the description to drawings, from which further advantageous embodiments, details and developments of the invention can be derived with reference to an exemplary embodiment, which has no limiting effect, in which.

DETAILED DESCRIPTION OF THE EXEMPLARY EMBODIMENTS

Figure 1:
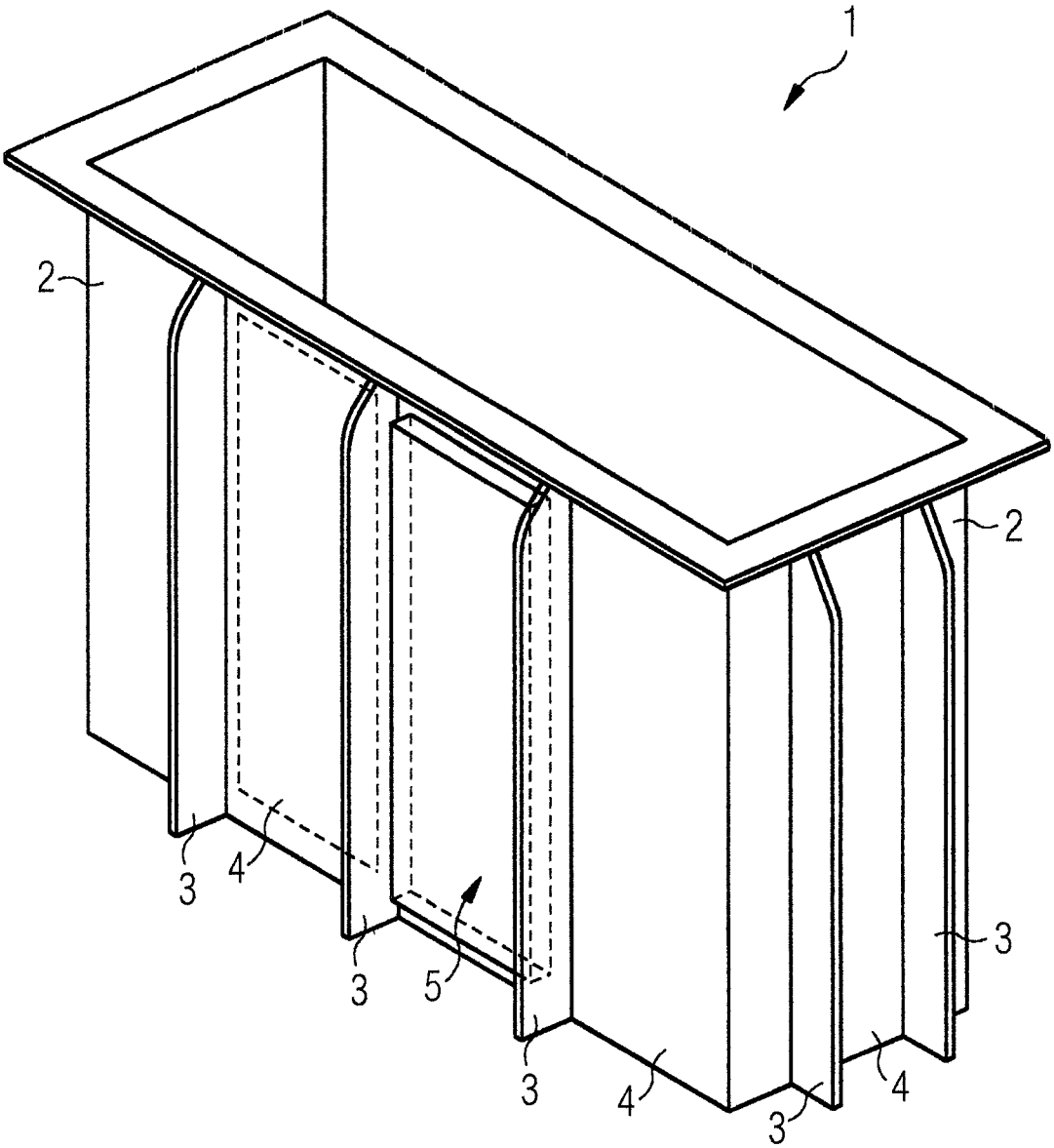
FIG. 1 shows a three-dimensional view of a tank of a transformer or choke comprising stiffeners on the external face, with the region between stiffeners being covered by sandwich panels in accordance with the invention.

FIG. 1 shows a perspective view of a tank 1 of a transformer or choke (not shown in greater detail). The tank 1 has side walls 2, on the external face of which vertically arranged stiffeners 3 are provided. Tank 1 and stiffeners 3 are made from a steel plate and welded to one another. The stiffeners 3 can be formed in various ways, for instance, as reinforcing ribs or in the form of a profile (e.g., a U-shaped profile of arm length 150 mm and a 250 mm link between arms). The stiffneners 3 provide mechanical stability to the tank 1, in particular during the stage of manufacture in which a negative pressure is applied to the interior of the tank. During operation, flexural vibrations are excited in the rectangular region 4 between the stiffeners 3, which region is covered by sandwich panels 5 (in FIG. 1, only one of these sandwich panels 5 is shown by way of example). These sandwich panels 5 act as insulating panels, i.e., they reduce the noise emitted during operation. The sandwich panels 5 are plate-shaped structures, which along their longitudinal extent are arranged vertically on the external face of the tank 1. The flexurally vibrating region 4 is covered by the planar extent of the structures. The sandwich panel 5 is formed as a sound-insulating cover plate, i.e., the length thereof extends vertically over the entire height of the tank 1. The width of the cover plate equals the distance between two stiffeners 3, which for a power transformer means 600 mm to 800 mm, for example.

Figure 2:
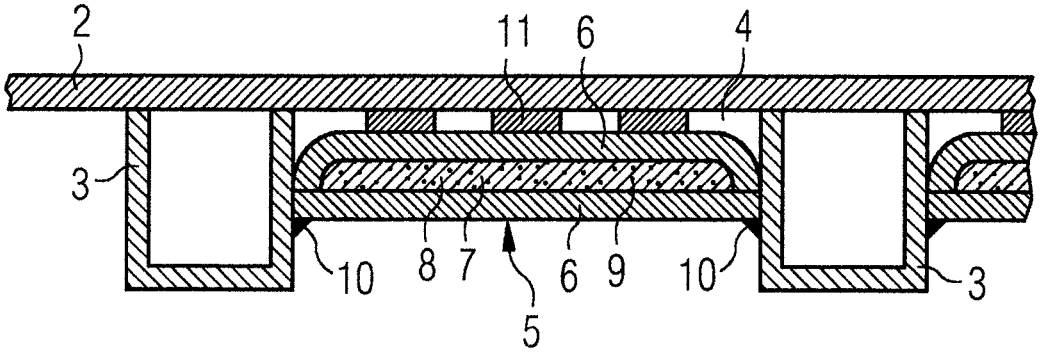
FIG. 2 shows a first embodiment of the invention as a sectional view of a segment of the tank wall, with the region between two stiffeners being covered by a sandwich panel, which is welded to the stiffener.

FIG. 2 shows in a cross-section a segment between two stiffeners 3. The stiffeners 3 have a U-shaped profile. The arms of the U-shaped profile are welded to the side wall 2 of the tank. The region 4 of the tank wall 2 between adjacently opposite arms 3 of the U-shaped profile is covered by a sandwich panel 5. The sandwich panel 5 has a cross-section that is substantially rectangular in form. A metallic casing 6 encloses a cavity 7. The cavity 7 is filled with a polymer material 8 containing a filler 9. In accordance with the invention, the composition between polymer material 8 and filler 9 is selected such that this composition has a specific weight of at least 2 g/cm$^3$. In a preferred embodiment of the invention, the polymer material 8 is an epoxy resin, and the filler 9 is a steel abrasive, namely steel particles of diameter 1 to 2 mm. This composition of epoxy resin 8 and steel abrasive 9 has a specific weight of approximately 5 g/cm$^3$.

In the exemplary embodiment of FIG. 2, the sandwich panel 5 is fitted by the casing 6 facing the tank wall 2, with the interposition of an elastic element 11. The elastic element 11 is formed by a plurality of rubber strips running parallel to the stiffener 1. The rubber strips adhere to the side wall 2 and to the casing 6 via an adhesive bond.

As already mentioned above, the casing 6 forms a complete enclosure for the cavity 7, i.e., the cavity 7 is hermetically sealed. The cavity 7 has an approximately rectangular cross-section. The long side of the rectangle equals approximately the clear width between adjacent stiffeners 3, i.e., approximately 600 mm to 800 mm for a power transformer, minus the wall thickness. The short side of the rectangular cavity 7 is approximately 30 mm. In the example shown, the casing 6 consists of a two-piece steel plate, with one piece in the shape of a trough and the other piece forming a cover to the trough. The steel plate has a thickness of approximately 5 mm. The trough and cover are welded together. Hence, the polymer material 8 contained in the cavity 7 is completely screened from external environmental influences, which also have no effect on the aging behavior of said material.

Figure 3:
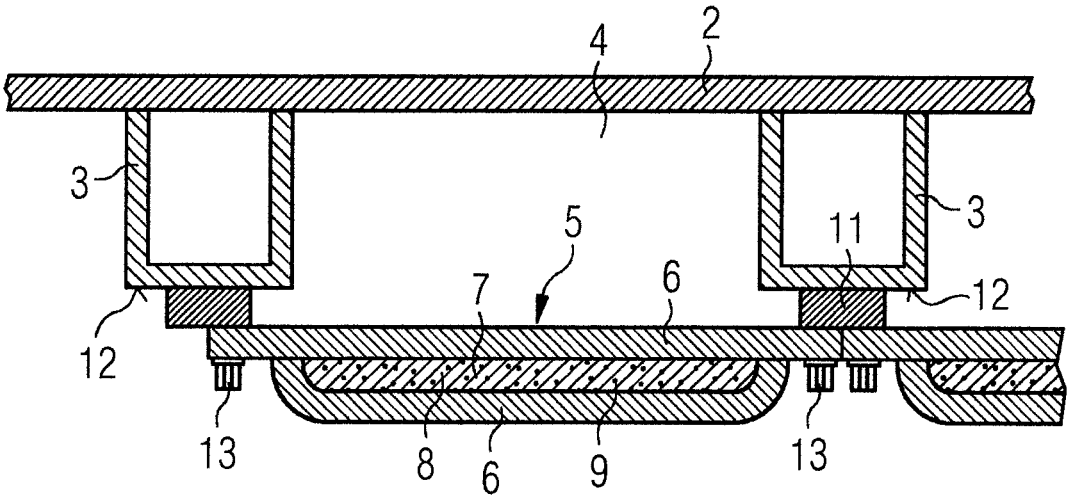
FIG. 3 shows a second embodiment of the invention as a sectional view of a segment of the tank wall, in which embodiment a sandwich panel is screwed on the end face of the stiffeners.

FIG. 3 shows another preferred embodiment of the invention. In this case, the region 4 between adjacent stiffeners 3 is again completely covered by a sandwich panel 5. The sandwich panel 5, however, is not attached by a welded joint to the arms of the stiffener 3 but is attached to an end face 12. At this end face 12, the sandwich panel 5 is screwed by screws 13 to the stiffener 3, with the interposition of an elastomer element 11. The elastomer element 11 consists of a band or strip made of rubber. The casing 6 and the region 4 are spaced apart from one another. The space between sandwich panel 5 and flexurally vibrating region 4 is an air gap.

Thus, while there are shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice.

The invention claimed is:

1. An arrangement for reducing the sound emission from liquid-cooled transformers or chokes, the arrangement comprising:

a tank having externally arranged stiffeners on side walls of the tank, each region of the side walls lying between the externally arranged stiffeners being covered by a corresponding sandwich panel attached to the externally arranged stiffeners;

wherein each sandwich panel includes a metallic casing that encircles a cavity to hermetically seal the cavity;

wherein the cavity is filled with a composition of a polymer material and a filler; and wherein said composition of the polymer material and the filler has a specific weight of >2 grams per cubic centimeter.

2. The arrangement as claimed in claim 1, wherein the polymer material is an epoxy resin.

3. The arrangement as claimed in claim 1, wherein the filler is a metallic material.

4. The arrangement as claimed in claim 2, wherein the filler is a metallic material.

5. The arrangement as claimed in claim 1, wherein the filler is silica sand.

6. The arrangement as claimed in claim 2, wherein the filler is silica sand.

7. The arrangement as claimed in claim 3, wherein each sandwich panel is formed as a cuboid.

8. The arrangement as claimed in claim 5, wherein each sandwich panel is formed as a cuboid.

9. The arrangement as claimed in claim 7, wherein each sandwich panel is arranged externally between adjacent stiffeners, and wherein a connection between the metallic casing of a sandwich panel and a stiffener comprises a welded joint.

10. The arrangement as claimed in claim 9, wherein each metallic casing of a sandwich panel that faces the side wall of the tank is arranged adjacent to a region with an interposition of an elastic element.

11. The arrangement as claimed in claim 7, wherein each sandwich panel is attached via a detachable connection on an end face of a stiffener, said end face facing away from the side wall of the tank, with an interposition of an elastic element.

12. The arrangement as claimed in claim 3, wherein the metallic filler is formed by steel abrasive.

13. The arrangement as claimed in claim 10, wherein the elastic element is formed by a strip made of an elastomer.

14. The arrangement as claimed in claim 11, wherein the elastic element is formed by a strip made of an elastomer.

* * * * *